US007391486B2

(12) United States Patent
Hong

(10) Patent No.: US 7,391,486 B2
(45) Date of Patent: Jun. 24, 2008

(54) FIELD SEQUENTIAL LCD DEVICE AND COLOR IMAGE DISPLAY METHOD THEREOF

(75) Inventor: Hyung-Ki Hong, Seoul (KR)

(73) Assignee: LG Display Co., Ltd., Seoul (KR)

( * ) Notice: Subject to any disclaimer, the term of this patent is extended or adjusted under 35 U.S.C. 154(b) by 275 days.

(21) Appl. No.: 11/004,086

(22) Filed: Dec. 6, 2004

(65) Prior Publication Data

US 2005/0094056 A1 May 5, 2005

Related U.S. Application Data

(62) Division of application No. 09/990,279, filed on Nov. 23, 2001.

(30) Foreign Application Priority Data

Nov. 23, 2000 (KR) ..... 2000-69850

(51) Int. Cl.
*G09G 3/36* (2006.01)

(52) U.S. Cl. ..... 349/106; 345/132; 345/88; 348/E9.024; 348/E5.073; 348/E5.077; 348/E9.042

(58) Field of Classification Search ..... 349/106; 345/132, 213, 88, 468
See application file for complete search history.

(56) References Cited

U.S. PATENT DOCUMENTS

| | | | | |
|---|---|---|---|---|
| 2001/0038371 | A1 * | 11/2001 | Yoshinaga et al. | 345/87 |
| 2002/0158823 | A1 * | 10/2002 | Zavracky et al. | 345/87 |
| 2006/0146007 | A1 * | 7/2006 | Lim et al. | 345/102 |

FOREIGN PATENT DOCUMENTS

| | | | |
|---|---|---|---|
| JP | 06-067149 | | 3/1994 |
| JP | 09-034400 | | 2/1997 |
| JP | 09-244594 | | 9/1997 |
| JP | 09-274472 | | 10/1997 |
| JP | 11-326864 | | 11/1999 |
| JP | 2000-028985 | | 1/2000 |
| JP | 2000-111871 | * | 4/2000 |
| JP | 2000-194067 | | 7/2000 |

* cited by examiner

*Primary Examiner*—A. Sefer
(74) *Attorney, Agent, or Firm*—McKenna Long & Aldridge LLP

(57) ABSTRACT

In a liquid crystal display device, a field sequential liquid crystal display device includes a liquid crystal panel having an upper substrate, a lower substrate and a liquid crystal layer therebetween; a backlight device under the liquid crystal panel for irradiating light to the liquid crystal panel and having three color light sources; and an image signal processor controlling a sequential lighting order and combination of the three color light sources.

13 Claims, 8 Drawing Sheets

FIELD SEQUENTIAL LCD DEVICE AND COLOR IMAGE DISPLAY METHOD THEREOF

This application is a divisional of prior application Ser. No. 09/990,279, filed Nov. 23, 2001, which claims priority to Korean Patent Application No. 2000-0069850, filed Nov. 23, 2000, which are hereby incorporated by reference for all purposes as if fully set forth herein.

This application claims the benefit of Korean Patent Application No. 2000-69850, filed on Nov. 23, 2000 in Korea, which is hereby incorporated by reference as if fully set forth herein.

BACKGROUND OF THE INVENTION

1. Field of the Invention

The present invention relates to an active-matrix liquid crystal display (AM LCD) device, and more particularly, to a field sequential liquid crystal display device and a method for displaying color images using the field sequential liquid crystal display device.

2. Discussion of the Related Art

Until now, the cathode-ray tube (CRT) has been generally used for display systems. However, flat panel displays are increasingly beginning to be used because of their small depth dimensions, desirably low weight, and low power consumption requirements. Presently, thin film transistor-liquid-crystal displays (TFT-LCDs) have been developed with a high resolution and small depth dimensions.

Generally, a liquid crystal display (LCD) device includes an upper substrate, a lower substrate, and a liquid crystal layer interposed therebetween. The upper and lower substrates respectively have electrodes opposing to each other. When an electric field is applied between the electrodes of the upper and lower substrates, molecules of the liquid crystal are aligned according to the electric field. By controlling the electric field, the liquid crystal display device provides various transmittances of incident light to display images.

In these days, an active-matrix liquid crystal display (AM LCD) device is the most popular because of its high resolution and superiority in displaying moving images. A typical active-matrix liquid crystal display has a plurality of switching elements and pixel electrodes, which are arranged in an array matrix on the lower substrate. Therefore, the lower substrate of the active-matrix liquid crystal display is alternatively referred to as an array substrate.

The structure of a conventional active-matrix liquid crystal display will be described hereinafter with reference to FIG. 1, which illustrates a cross section of a pixel region. The liquid crystal display 10 consists of a liquid crystal panel 15 and back light 50. The liquid crystal panel 15 includes a color filter substrate (i.e., an upper substrate) 20 and an array substrate (i.e., a lower substrate) 40 which face each other across a liquid crystal layer 30. Within the color filter substrate 20, a color filter consisting of red (R), green (G), and blue (B) and a black matrix 22*b* are formed on a transparent substrate 1 for preventing a light leakage. The common electrode 24, which functions as one electrode for applying a voltage to the liquid crystal layer 30, is formed on the color filter 22*a* and black matrix 22*b*.

Within the lower substrate 40 of FIG. 1, a thin film transistor "T" functioning as a switching element is formed over the transparent substrate 1 facing the upper substrate 20. A pixel electrode 42, which is electrically connected to the thin film transistor "T" and serves as another electrode for applying a voltage to the liquid crystal layer 30, is formed over the transparent substrate 1 of the array substrate 40. The back light 50 is disposed under the array substrate 40 to irradiate light to the liquid crystal panel 15. Although not shown in FIG. 1, the thin film transistor generally comprises a gate electrode, a source electrode and a drain electrode.

This liquid crystal display device described above uses an optical anisotropy and polarization property of liquid crystal molecules for displaying a desired image. That is, applying a voltage to the liquid crystal molecules having a thin and long structure and pretilt angle changes an alignment direction of the liquid crystal molecules. Thereafter, light incident from the back light device is polarized due to the optical anisotropy of the liquid crystal molecules. And lastly, the polarized light is modulated by passing through the color filter layer, and thus color images are displayed.

But the conventional active-matrix liquid crystal display device has some problems as follows. Firstly, the material used for the color filter is expensive, resulting in an increase of the manufacturing cost. Secondly, because the transmissivity of a material used for the color filter is less than 33% so that a brighter back light is required in order to display a color image effectively, which results in the increase of the power consumption.

Research and development have been conducted recently in an effort to overcome these problems. Therefore, a field sequential liquid crystal display (FS LCD) device, which displays a full color without the color filters, is suggested as an alternative.

The conventional active-matrix liquid crystal display devices display the color image by constantly transmitting white light from the back light to the liquid crystal panel, whereas the FS LCD devices display the color image by sequentially and periodically turning on and off the light sources having Red, Green and Blue colors. Though the field sequential liquid crystal display device has not been popular until recently because of the lack of a short response time of the liquid crystal molecules, it can be popularized in the field thanks to a development of new liquid crystal molecules having a short response time, such as Ferroelectric Liquid Crystal (FLC), Optical Compensated Birefringent (OCB) and Twisted Nematic (TN).

In addition, the Optical Compensated Birefringent (OCB) mode is generally used for the field sequential liquid crystal display device because the OCB mode forms a bend-structure and the response time thereof is less than about 5 msec when the voltage is applied thereto. Therefore, the OCB mode liquid crystal cells of the OCB mode are suitable for the field sequential liquid crystal display device owing to the short response time leaving no residual image on a screen.

FIG. 2 is a cross-sectional view illustrating the schematic cross section of the conventional field sequential liquid crystal display device. The conventional field sequential liquid crystal display device 60 includes an upper substrate 64 (referred to as a color filter substrate), a lower substrate 66 (referred to as an array substrate), a liquid crystal layer 70 interposed therebetween and a back light device 72 consisting of three light sources Red (R), Green (G) and Blue (B) to irradiate light to the liquid crystal panel 62. A black matrix 61 is formed between the common electrode 65 and the transparent substrate 1 of the upper substrate 64 in order to prevent leakage of light in a non-display region other than a region for a pixel electrode 67. A thin film transistor "T", which functions as a switching element and is electrically connected to the pixel electrode 67, is formed over the transparent substrate 1 of the lower substrate 66. The thin film transistor "T" corresponding to the black matrix 61 consists of gate, source and drain electrodes (not shown).

The biggest difference of the field sequential liquid crystal display (FS LCD) device 60 with the conventional liquid crystal display of FIG. 1 is that the FS LCD device does not need the color filters in the upper substrate 64 and has a back light device that includes three different light sources that are sequentially and selectively turned on and/or off. The light sources having Red (R), Green (G) and Blue (B) colors are driven respectively by an inverter (not shown) and each of Red, Green and Blue light sources is turned on and off sixty times per second, resulting in one hundred and eighty times per second in all.

Therefore, a color image caused by the mixture of three colors (red, green and blue) is displayed using an afterimage (i.e., residual image) effect of human vision. Though the Red, Green and Blue light sources are turned on and off one hundred and eighty time per second, the perception by the naked eye is that the light sources are kept on due to the afterimage (or residual image) effect. For example, if the Red light source is turned on and then the Blue light source is sequentially turned on, a mixed color (i.e., violet) is shown owing to the residual image effect.

Since the FS LCD devices do not need the color filters, the FS LCD devices overcome the problem that the conventional active-matrix liquid crystal display devices cause the decrease of the luminance due to the color filters. In addition, the FS LCD devices are suitable for the liquid crystal display devices of a large scale because they can display a full-color using three-color light sources whereby they can display an image of high luminance and high resolution. Though the conventional active-matrix liquid crystal display device is inferior to CRT (Cathode Ray Tube) in terms of price or resolution, the field sequential liquid crystal display device can solve these problems.

FIG. 3 is a flow chart schematically showing an operation of a field sequential liquid crystal display device according to a conventional color image display method. In the initial step "st1", a single frame as an image display unit is divided into three subframes each having one—one hundred eightieth of a second (1/180 second) period. In step "st2", electric signals are applied to pixels of the FS LCD panel at 1/180 second interval. At this time when the electric signals are applied, the thin film transistors are operated as switching devices such that the liquid crystal molecules are arranged according to the signals. Further within one frame, the primarily arranged liquid crystal molecules of one pixel continue to maintain their status until the liquid crystal molecules of the last pixel are arranged. In step "st3", when the liquid crystal molecules of the designated frame are all arranged, the light sources are turned on in the designated pixel. Namely, the light sources of the backlight device of the conventional FS LCD device are turned on sequentially, respectively, periodically and repeatedly without the additional control devices.

FIG. 4 is a graph showing a gray level of the emitted light depending on a light source. In general, the liquid crystal panel for the FS LCD device does not include the color filter contrary to the conventional LCD device, such that the liquid crystal panel displays a black color unless the light source irradiates light. The gray level of the initially inputted signal is defined by multiplying a gray level of the black-and-white liquid crystal panel by a gray level of backlight. As shown in FIG. 4, the Red, Green and Blue light sources forms one frame "1*f*" and are sequentially turned on/off. The brightness of Red, Green and Blue light sources is respectively represented by L1, L2 and L3 in FIG. 4. In this graph of FIG. 4, if the gray level of inputted signal and the gray level of black liquid crystal level are maintained at fixed values, it is obvious the picture brightness depends on the backlight.

However, since the Red, Green and Blue light sources are sequentially turned on and off in the conventional FS LCD devices without extra control devices, the maximum brightness is limited to 1*b* that represents the brightness L2. Namely, when the brightness L2 of the Green light source is calculated in gray level (i.e., 1*b*), the gray level 1*b* represents the maximum brightness among the light sources such that the maximum brightness of the Red, Green and Blue light sources is less than the gray level 1*b*.

FIG. 5 is a graph of the lighting time of the subframes, plotted as a function of the time according to the Red (R), Green (G) and Blue (B) light sources. As shown in FIG. 5, 1/60 second as one frame (1*f*) is divided into first sf1, second sf2 and third sf3 subframes. At this time, each Red (R), Green (G) or Blue (B) light source of the subframes is substantially turned on for less than 1/180 second because the duration of each subframe sf1, sf2 or sf3 takes into account the duration of applying the electric signal, aligning the liquid crystal molecules and turning on the backlight device. Therefore, if each light source of the subframe is thoroughly turned on for 1/180 second, the light leakage can occur because the light is irradiated before the aligning of the liquid crystal molecules. Furthermore, the color interference may occur between the light sources of the subframes. In other words, switching on and off the light source of each subframe is carried out after applying the electric signals and aligning the liquid crystal molecules, and depends on the thin film transistors and the condition of the liquid crystal molecules.

However, since the conventional FS LCD devices does not have a control device controlling the light sources of the backlight device, the light leakage and the decrease of display quality occur in the conventional FS LCD devices whenever the design of the thin film transistor changes.

SUMMARY OF THE INVENTION

Accordingly, the present invention is directed to a field sequential liquid crystal display (FS LCD) device and a color image display method of the field sequential liquid crystal display (FS LCD) device that substantially obviates one or more of problems due to limitations and disadvantages of the related art.

An object of the present invention is to provide a field sequential liquid crystal display device having an on/off controller for thin film transistors and three-color light sources.

Another object of the present invention is to provide a color image display method for a field sequential liquid crystal display device including an image signal processor in which each of Red, Green and Blue light sources is driven sequentially for displaying color images.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a field sequential liquid crystal display device includes a liquid crystal panel having an upper substrate, a lower substrate and a liquid crystal layer therebetween; a backlight device under the liquid crystal panel for irradiating light to the liquid crystal panel and having three color light sources; and an image signal processor controlling a sequential lighting order and combination of the three color light sources.

In the above-mentioned device, each of the three color light sources has one of colors Cyan, Magenta and Yellow. Also, each of the three color light sources can have one of colors Red, Green and Blue. The image signal processor changes the lighting order and combination of the three color light sources depending on image characteristics displayed in the liquid crystal panel. The liquid crystal layer is Optical Compensated Birefringent (OCB) mode or Ferroelectric Liquid Crystal (FLC) mode. The three color light sources are sequentially lit for 1/180 second at three subframes when one frame period is 1/60 second. A lighting time of each of the light sources at each subframe can be less than 1/180 second.

In another aspect, a color image display method for a field sequential liquid crystal display device that includes a liquid crystal panel having an upper substrate, a lower substrate, a liquid crystal layer therebetween, and a plurality of pixels, a backlight device under the liquid crystal panel for irradiating light to the liquid crystal panel and having Red, Green and Blue light sources, and an image signal processor controlling a sequential lighting order and combination of the Red, Green and Blue light sources, the method including the steps of: dividing one frame into first, second and third subframes, wherein each subframe has a period of one-third of one frame period; applying an image signal to each pixel of the liquid crystal panel through the image signal processor, the image signal depending on image characteristics displayed in the liquid crystal panel; and lighting the Red, Green and Blue light sources at the subframes through the image signal processor by way of combining the lighting order thereof.

In the above-mentioned method, when a displayed image requires a higher brightness, the combination of the Red (R), Green (G), and Blue (B) light sources turned on each subframe is one of sequential combinations consisting of B+G, R+B and R+G to display Cyan (C), Magenta (M) and Yellow (Y) colors, respectively. The image signal processor converts the image signal into a signal corresponding to a C-M-Y mode when the C, M and Y colors are generated, and applies the converted signal to the plurality of the pixels. The image signal processor sequentially lights the R, G and B light sources at each subframe in accordance with the C-M-Y mode.

Furthermore, one frame period is 1/60 period and a lighting time of each of the Red, Green and Blue light sources is less than 1/180 second. When the displayed image needs an emphasized color, one of the R, G and B light sources are turned on and off more frequently than the other two light sources. For example, when Red is the emphasized color, the R light sources is turned on and off not only at the first subframe but also at one or both of the second and third subframes.

In another aspect, a color image display method for a field sequential liquid crystal display device that includes a liquid crystal panel having an upper substrate, a lower substrate, a liquid crystal layer therebetween, and a plurality of pixels, a backlight device under the liquid crystal panel for irradiating light to the liquid crystal panel and having Red (R), Green (G) and Blue (B) light sources, and an image signal processor controlling an image signal and a sequential lighting order and combination of the Red, Green and Blue light sources, the method including the steps of: expressing a brightness of each component R, G and B with a gray level having 256 levels; setting the brightness of each component R, G and B as a maximum brightness when the brightness of each component R, G and B has a value of gray level 127; calculating the average brightness value of each of the components R, G and B; classifying cases in accordance with the image signal by which the average brightness values of the components R, G and B is greater than the maximum brightness of the displayed image; and determining which light sources are turned on at the subframes in each case. Wherein the number of the turned-on light sources at each subframe is less than two. Classifying the cases depends on the range of the average brightness values of the component R, G and B. Turning on the light sources is determined by a value that doubles a minimum values of the components R, G and B in the chromaticity coordinate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiment of the present invention, which is illustrated in the accompanying drawings. Wherever possible, the same reference numbers will be used throughout the drawings to refer to the same or like parts.

Figure 1:
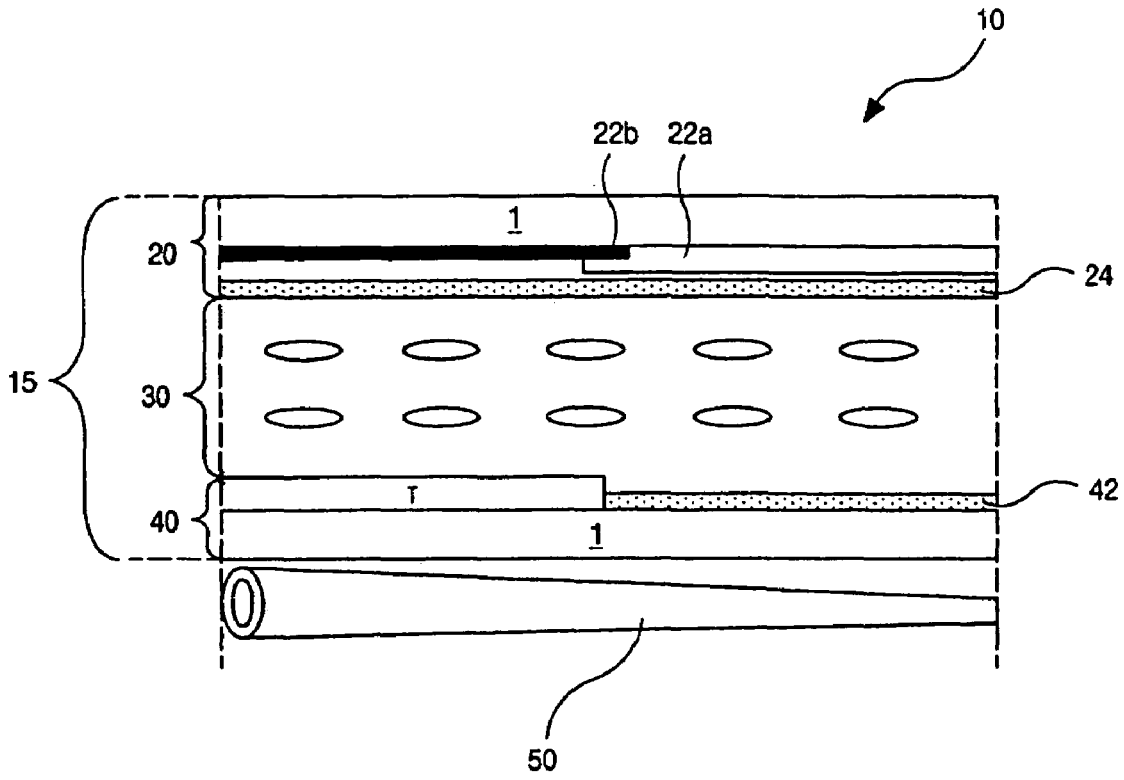
FIG. 1 (RELATED ART)
FIG. 1 is a cross-sectional view showing a pixel of a conventional liquid crystal display, device.
Figure 2:
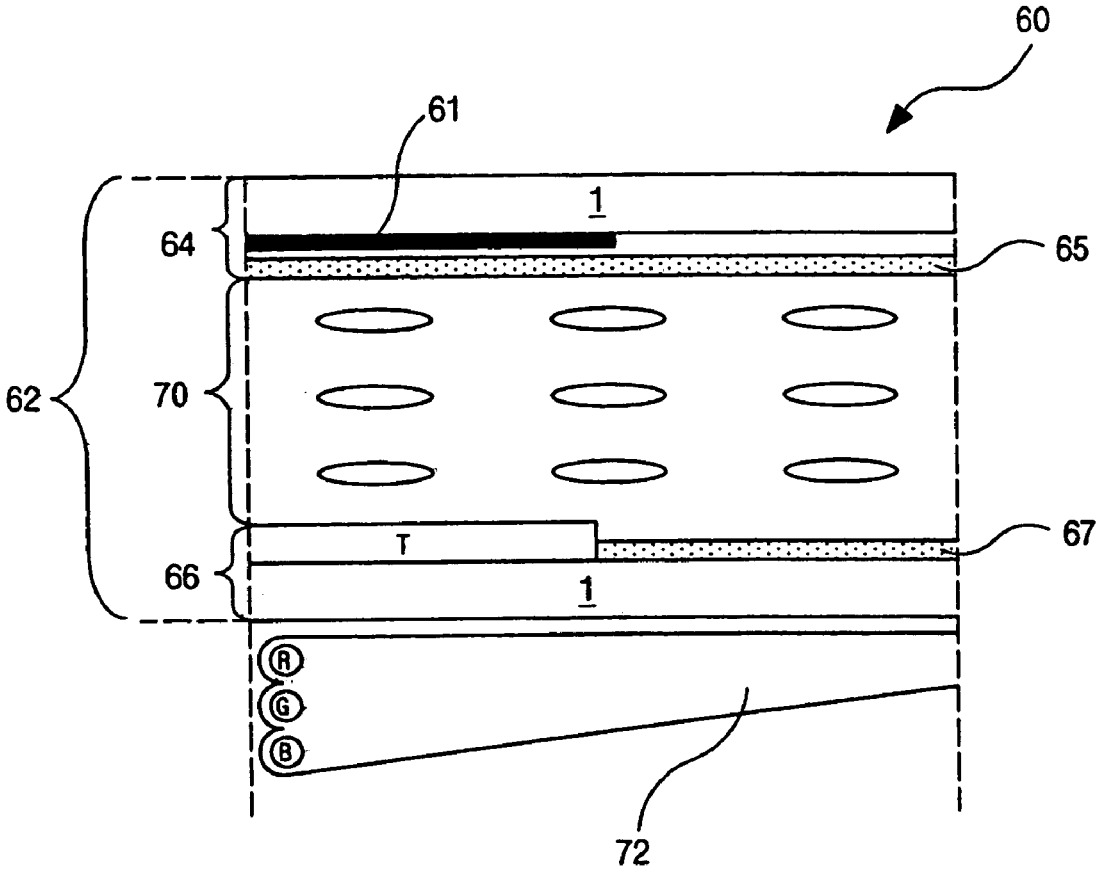
FIG. 2 (RELATED ART)
FIG. 2 is a cross-sectional view illustrating the schematic cross section of a conventional field sequential liquid crystal display device.
Figure 3:
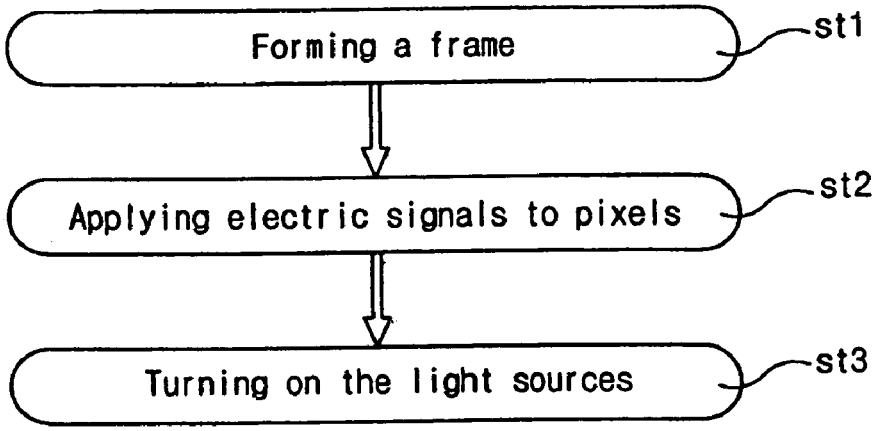
FIG. 3 (RELATED ART)
FIG. 3 is a flow chart schematically showing an operation of a field sequential liquid crystal display device according to a conventional color image display method.
Figure 6:
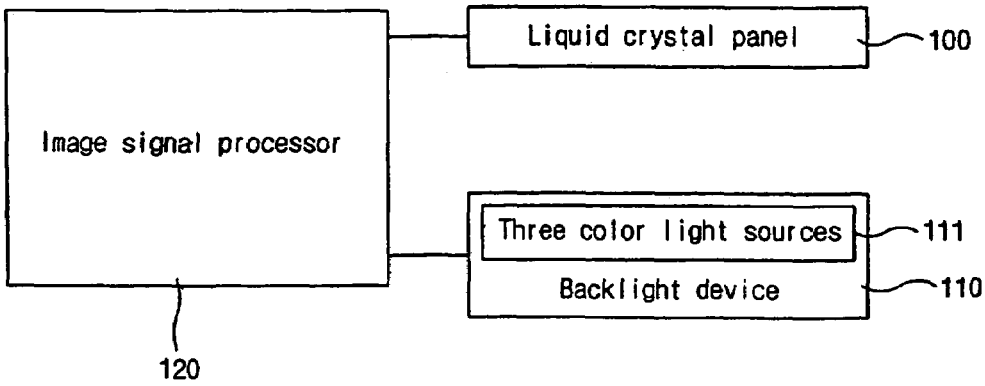
FIG. 6 is a schematic diagram illustrating a field sequential liquid crystal display device according to the present invention.

FIG. 6 is a schematic diagram illustrating a field sequential liquid crystal display (FS LCD) device according to the present invention. As shown in FIG. 6, the FS LCD of the present invention comprises a liquid crystal panel 100 consisting of a pair of substrates, a backlight device 110, including three color light sources 111, which is placed below the liquid crystal panel 100, and an image signal processor controlling the sequential lighting order and combination of the three color light sources 111. The liquid crystal panel 100 has the same structure and configuration as the liquid crystal panel of the conventional FS LCD as shown in FIG. 2. The three color light sources 111 of the backlight device 110 have three colors (Red, Green and Blue or Cyan, Magenta and Yellow). The image signal processor 120 controls the backlight device 110 and the image signals applied to the pixel of the liquid crystal panel 100, thereby maximizing the brightness and increasing the brightness of the desired color. For the liquid crystal of the present invention, Ferroelectric Liquid Crystal (FLC), Opitcally Compensated Birefringent (OCB) liquid crystal or Twisted Nematic (TN) liquid crystal is used. Further, the backlight device 110 of the present invention is one of the wave guide type and the direct type. The wave guide type backlight device has the light sources disposed at one edge or both edges of the liquid crystal panel 100 and diffuses light using a light guide panel and reflector. The direct type backlight device has three color (Red, Green and Blue) light sources disposed in a repeated sequence of Red, Green and Blue under the liquid crystal panel 100 and irradiates light directly to the liquid crystal panel 100.

In a first embodiment of the present invention, the backlight device has three color light sources Cyan (C), Magenta (M) and Yellow (Y). As widely known, the three colors Cyan (C), Magenta (M) and Yellow (Y) consist of the color combination of Blue (B)+Green (G), Red (R)+Blue (B) and Red (R)+Green (G), respectively. Since the light efficiency of the C, M and Y light sources is twice as much as that of the R, G and B light sources, the maximum brightness of the image can be increased.

Figure 4:
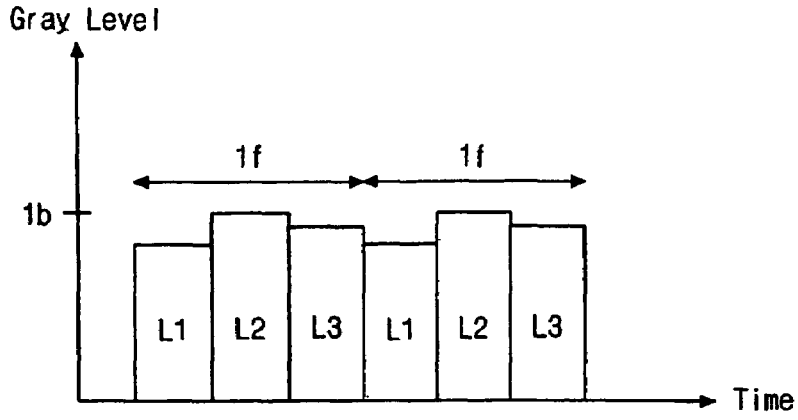
FIG. 4 (RELATED ART)
FIG. 4 is a graph showing a gray level of the emitted light depending on a light source.
Figure 7:
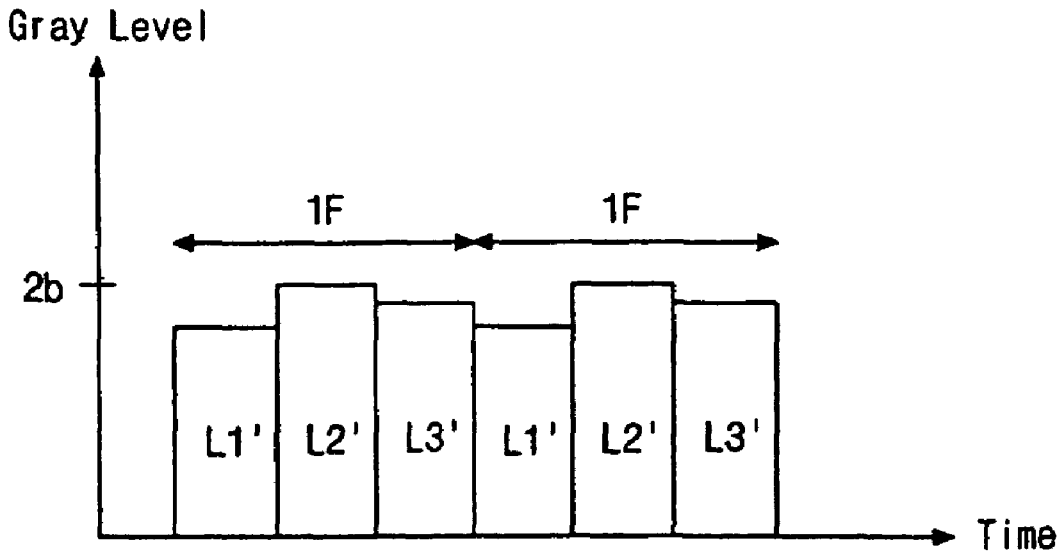
FIG. 7 is a graph showing a gray level of the emitted light depending on a light source of each subframe according to a first embodiment of the present invention.

FIG. 7 is a graph showing a gray level of the emitted light depending on a light source of each subframe according to a first embodiment of the present invention. As shown in FIG. 7, the C, M and Y light sources of the backlight device 110 (in FIG. 6) constitute one frame 1F and are sequentially turned on. The gray levels of the emitted light from the C, M and Y light sources are represented by L1', L2' and L3', respectively. At this point, since the light efficiency of the C, M and Y light sources is twice as much as that of R, G and B light sources, the maximum gray level L2' is twice as large than L2 of FIG. 4. Therefore, the maximum gray level L2' is represented by "2*b*", as shown in FIG. 7.

Since, the C, M and Y light sources of the first embodiment has a chromaticity close to white rather than the R, G and B light sources, the C, M and Y light sources have the higher brightness than the R, G and B light sources. Therefore, it is possible that the maximum brightness to display increases.

Figure 5:
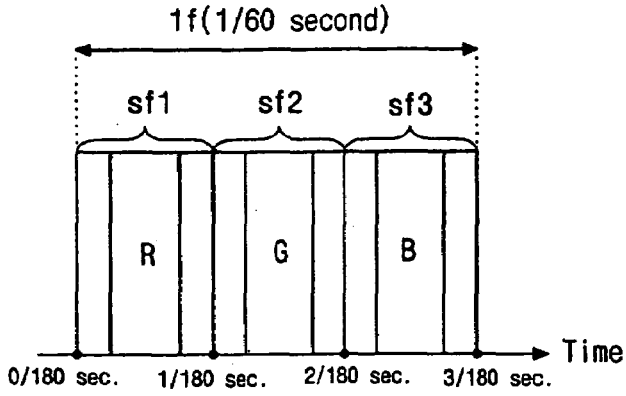
FIG. 5 (RELATED ART)
FIG. 5 is a graph of the lighting time of the subframes, plotted as a function of the time according to the Red (R), Green (G) and Blue (B) light sources.
Figure 8:
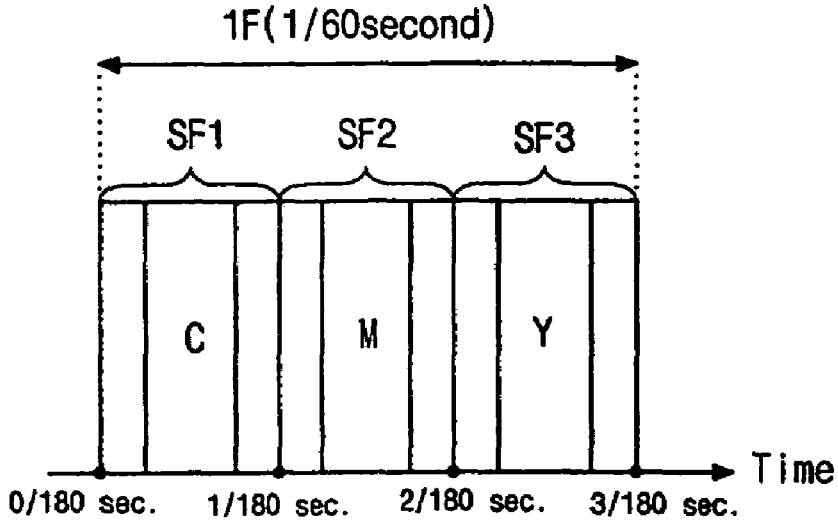
FIG. 8 is a graph of the lighting time of the subframes, plotted as a function of the time according to the Cyan (C), Magenta (M) and Yellow (Y) light sources of the first embodiment.

FIG. 8 is a graph of the lighting time of the subframes, plotted as a function of the time according to the Cyan (C), Magenta (M) and Yellow (Y) light sources of the first embodiment. As shown FIG. 8, 1/60 second as one frame 1F is divided into first SF1, second SF2 and third SF3 subframes such like the conventional art shown in FIG. 5. However, the light sources of the subframes have the Cyan (C), Magenta (M) and Yellow (Y) colors according to the first embodiment of the present invention. At this time, each C, M or Y light source of the subframes is substantially turned on for less than 1/180 second because each subframe SF1, SF2 or SF3 takes into account applying the electric signal, aligning the liquid crystal molecules and turning on the backlight device. As described in FIG. 7, the brightness of the C, M and Y light sources is twice as much as the conventional art, and the C, M and Y light sources are sequentially lit to display the desired images.

Accordingly in the FS LCD device according to the first embodiment of the present invention, the C, M and Y light sources are used and the image signal processor controls the image signals to be suitable for the C, M and Y light sources, thereby controlling the gray levels of the displayed colors of the images.

In the FS LCD device according to a second embodiment of the present invention, the three color light sources 111 of the backlight device 110 (in FIG. 6) have Red (R), Green (G) and Blue (B) colors, respectively. Further, the image signal processor 120 (in FIG. 6) of the second embodiment controls the image signals and the lighting order and combination of the R, G and B light sources. Therefore, a R-G-B mode and a C-M-Y mode can selectively be used.

In the R-G-B mode, the R, G and B light sources are used in each subframe in a manner similar to C-M-Y mode in that they are sequentially turned on and off. However, the R-G-B mode can be operated to display C, M and Y because the R, G and B light sources can display the Cyan (C), Magenta (M) and Yellow (Y) colors in the subframes by way of the combination G+B, R+B and R+G, respectively. Further, to display C, M and Y, pairs of light sources are sequentially turned on and off to display C (G+B), M (B+R) and Y (R+G) colors. Accordingly, the R-G-B mode can be converted in the C-M-Y mode and the C-M-Y mode in the R-G-B mode using the image signal processor 120 of FIG. 6. Additionally at the time of the conversion, the image signals applied to the pixel and the lighting order and combination of the R, G and B light sources are appropriately controlled.

Figure 9:
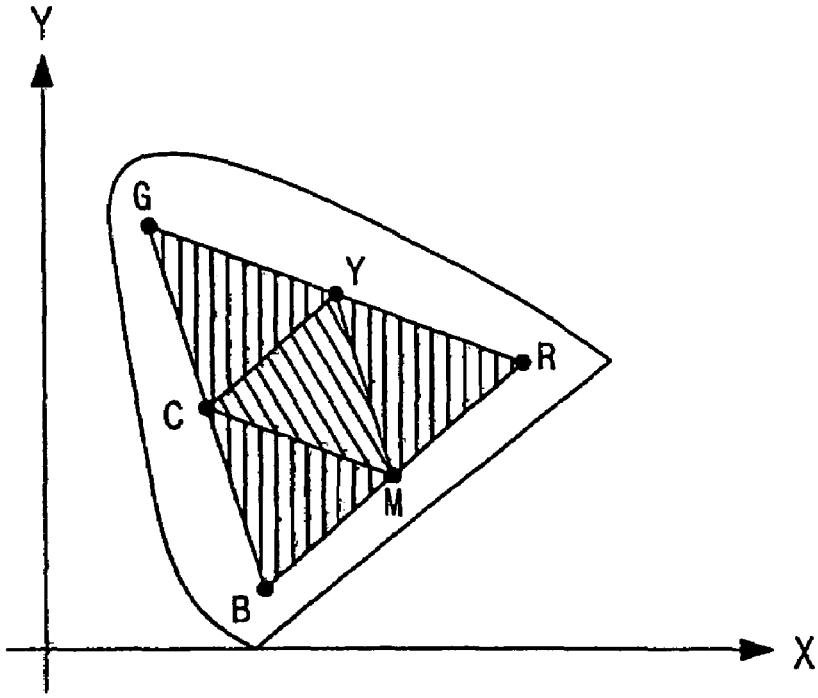
FIG. 9 is a schematic diagram showing color coordinates of a color gamut of the field sequential liquid crystal display device according to the present invention.

FIG. 9 is a schematic diagram showing color coordinates of a color gamut of the field sequential liquid crystal display device according to the present invention. As shown in FIG. 9, an outer parabolic area of the color gamut represents the color range the human eye can perceive, and triangular areas consisting of C-M-Y and R-G-B coordinates represent the chromaticity coordinates that the FS LCD of the second embodiment can display. Namely, in comparing the chromatic coordinates, although the C, M and Y light sources has better light efficiency than the R, G and B light sources, the color gamut of the C, M and Y light sources is narrower than the R, G and B light sources. Therefore, if the backlight device 110 of FIG. 6 includes only one of the R-G-B mode and C-M-Y mode light sources, it is difficult to satisfy both the light efficiency and color reproduction of the FS LCD device.

Figure 10:
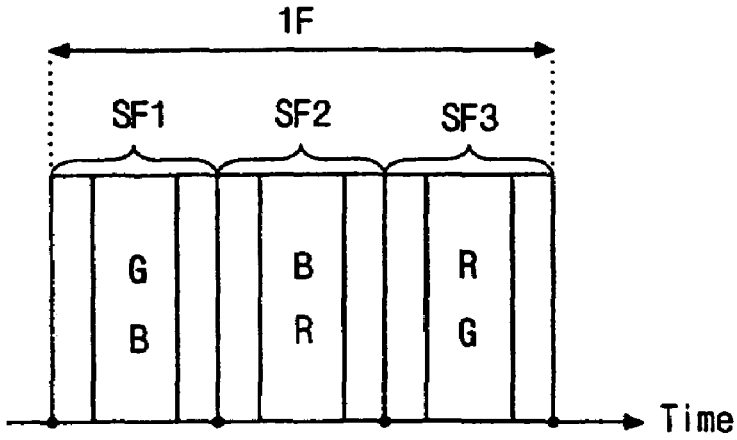
FIG. 10 is a graph of the lighting time of the subframes, plotted as a function of the time according to the combination of the Red (R), Green (G) and Blue (B) light sources of a second embodiment of the present invention in order to display Cyan (C), Magenta (M) and Yellow (Y) colors.

FIG. 10 is a graph of the lighting time of the subframes, plotted as a function of the time according to the combination of the Red (R), Green (G) and Blue (B) light sources of the second embodiment of the present invention in order to display Cyan (C), Magenta (M) and Yellow (Y) colors. As shown in FIG. 10, the B and G light sources are simultaneously turned on in the first subframe SF1, the R and B light sources are simultaneously turned on in the second subframe SF2, and the G and R light sources are simultaneously turned on in the third subframe SF 3. Therefore, the combination of B+G in the first subframe SF1 shows the Cyan (C) color, the combination of R+G to Magenta (M), and the combination of G+R to Yellow (Y). On this account, the brightness of the displayed pictures in this C-M-Y mode increases over that in the R-G-B mode.

Figure 11:
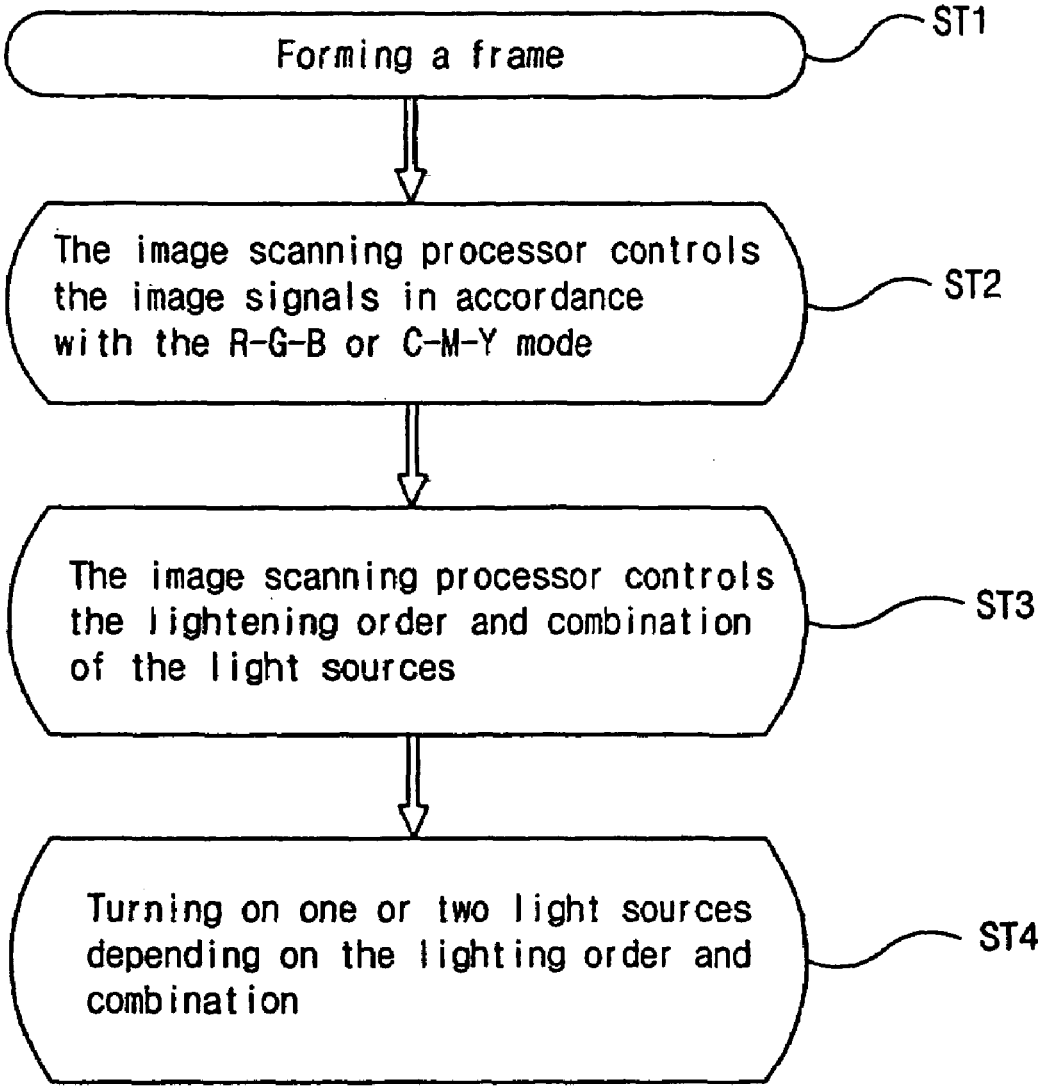
FIG. 11 is a flow chart schematically showing a color image display method for a field sequential liquid crystal display device according to the second embodiment of the present invention.

FIG. 11 is a flow chart schematically showing a color image display method for a field sequential liquid crystal display (FS LCD) device according to the second embodiment of the present invention. In the FS LCD device of the present invention, it is noticeable that the single frame includes three subframes.

In the initial step ST1, a single frame having a periodicity of 1/60 second is divided into three subframes each having one-one hundred eightieth of a second (1/180 second)period. In step ST2, the image signal processor 120 of FIG. 6 selects one of the R-G-B mode and the C-M-Y mode. Thus, the image signals applied to the pixels is controlled by this image signal processor 120 in accordance with the selected mode. In step ST3, the image signal processor controls the lighting order and combination of the light sources of the backlight device, in accordance with the image signals of the step ST2. In step ST4, the one or two light sources of the backlight device are turned on in each subframe depending on the lighting order and combination of the light sources.

Although the above-described light sources of the backlight device are lit respectively and repeatedly by subframe period, these light sources of the subframes is sensed by the human eye as one frame. Additionally in the FS LCD device of the present invention, since the number of the light sources is adjustable, the maximum brightness of the FS LCD device can be increased.

Accordingly, the FS LCD device according to the second embodiment of the present invention can select the R-G-B mode or the C-M-Y mode. If the displayed picture requires the higher brightness close to white color, the C-M-Y mode is selected to increase the light efficiency. Also, if the color reproduction needs to be expanded rather than increasing the light efficiency, the R-G-B mode is selected in the FS LCD device according to the second embodiment of the present invention. In other words, since the image signal processor can control the image signal and the on/off of the light sources depending on the picture's characteristics, the FS LCD of the second embodiment can be utilized in various display devices.

In a third embodiment of the present invention, the FS LCD device can display and emphasize a certain color of the displayed picture. The FS LCD device of the third embodiment also includes the R, G and B light sources in the backlight-device, and these R, G and B light sources are sequentially lit in each subframe. When the certain color needs to be emphasized, the image signal processor also controls the image signals and the lighting order and combination of the R, G and B light sources.

Figure 12:
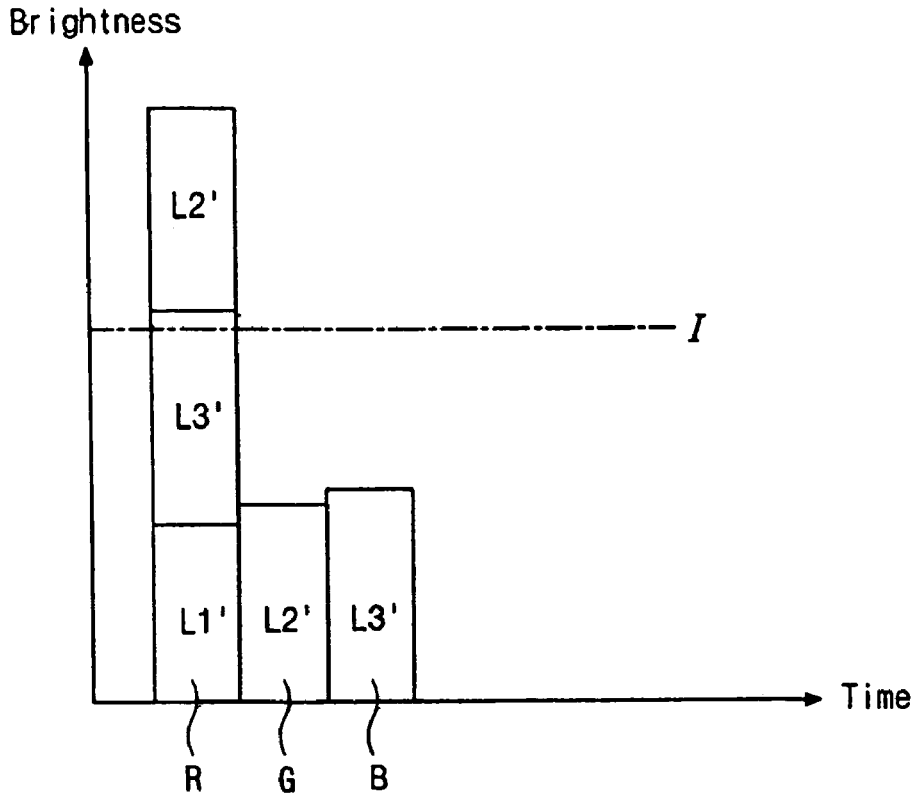
FIG. 12 is a graph showing a brightness of the emitted light depending on a light source of each subframe when the color image, for example, has a strong Red (R) color according to a third embodiment of the present invention.

FIG. 12 is a graph showing a brightness of the emitted light depending on a light source of each subframe when the color image has a strong Red (R) color, for example, according to a third embodiment of the present invention. When the color image picture has a strong Red (R) color, the Red light source is turned on not only in the first frame SF1 but also in the second SF2 and third SF3 frames. Therefore as shown in FIG. 12, the brightness of the R light source is represented by the combination of L1'+L2'+L3'. Further, the brightness of the G and B light sources are represented by L2' and L3', respectively. Namely, in order to emphasize the R color, the R light source is turned on in all subframes, and thus, the brightness of the Red (R) color is three times higher than the Green (G) and Blue (B) colors.

Accordingly in the third embodiment of the present invention, when compared to the brightness value "I" that is the maximum brightness of one light source, the range of the maximum brightness increase and is more expanded in display.

Figure 13:
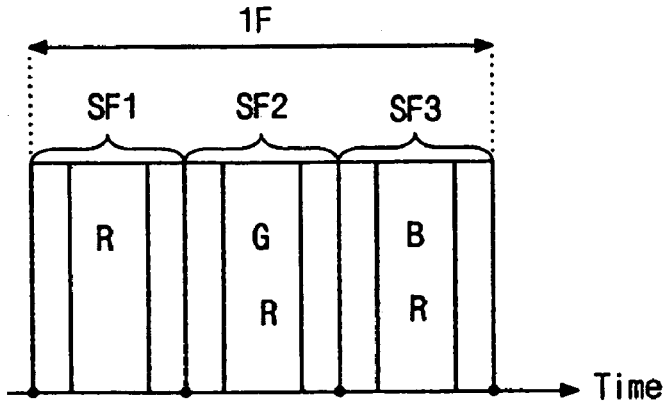
FIG. 13 is a graph of the lighting time of the subframes, plotted as a function of the time according to the combination of the Red (R), Green (G) and Blue (B) light sources when the color image, for example, has a strong Red (R) color according to the third embodiment of the present invention.

FIG. 13 is a graph of the lighting time of the subframes, plotted as a function of the time according to the combination of the Red (R), Green (G) and Blue (B) light sources when the color image has a strong Red (R) color, for example, according to the third embodiment of the present invention. As shown in FIG. 13, when the color image has the strong R color, the R light source is turned on not only in the first subframe SF1, but also in the second and third subframes SF2 and SF3. Since the R light source is turned on in all subframes, the brightness of the R light source increases three times. Since the G and B light sources are respectively turned on in the second SF2 and third SF3 frames, the brightness of the G and B light sources stays the same. Thus, the brightness of the desired color, e.g., Red (R) color, can be emphasized and increased.

Furthermore in the third embodiment of the present invention, it is possible that the desired color, e.g., the Red color, can be emphasized by two subframes. Namely, the R light source can be turned on in the first SF1 and second SF2 subframes or in the first SF1 and third SF3 subframes. Therefore, the brightness of the desired color (e.g., Red color) can also be increased.

The lighting scheme of the third embodiment can be used to emphasize a color other than Red, which is used herein as an example. For example, the scheme of the third embodiment can be applied to emphasize blue or green, or a combination of R, G and B colors.

In a fourth embodiment of the present invention, the second embodiment and the third embodiment are utilized and combined. Depending on the color image characteristics, the image signal processor of the fourth embodiment controls the image signals and the on/off of the light sources. The color image is classified into the image that needs to be displayed by the R-G-B mode, the image that needs to be displayed by the C-M-Y mode and the image that needs to be displayed by emphasizing a certain color. Thus, the image signal processor controls the image signals and light sources by selecting one of the above-mentioned display methods (the R-G-B mode, the C-M-Y mode and emphasizing a certain color).

For more detailed explanation, when the R-G-B mode is converted into the C-M-Y mode, the value of the chromaticity coordinate for the image signal is represented as follows:

$$R+G=Y/2$$

$$G+B=C/2$$

$$B+R=M/2$$

Namely, since the Cyan (C), Magenta (M) and Yellow (Y) have the high brightness rather than the Red (R), Green (G) and Blue (B), the relation between the R-G-B mode and the C-M-Y mode is expressed by the above-mentioned equations in order to control the image signal. As the brightness of the colors is different from each other, the image signal should be converted depending on the color in order to be matched with the light source of the backlight device whenever the light sources are turned on and off.

Suppose that the gray level of the ambient light is A1, the gray level substantially shown in the display panel is A2, and the brightness of the backlight is A3. The gray level A1 is equal to the gray level A2 (i.e., A1=A2) in the conventional liquid crystal display device having the color filters. However, in the FS LCD device of the present invention, the gray lever A1 is represented by multiplying the gray level A2 by the gray level A3 (i.e., A1=A2×A3) because the color image is displayed by the color light sources and the liquid crystal panel having no color filters. Accordingly, whenever the sequential lighting method of the light sources changes, the image signal also changes. Since the image signal processor according to the present invention makes the multiplied gray level A2×A3 be matched with the gray level A1, the high brightness and the high definition are obtained.

Figure 14:
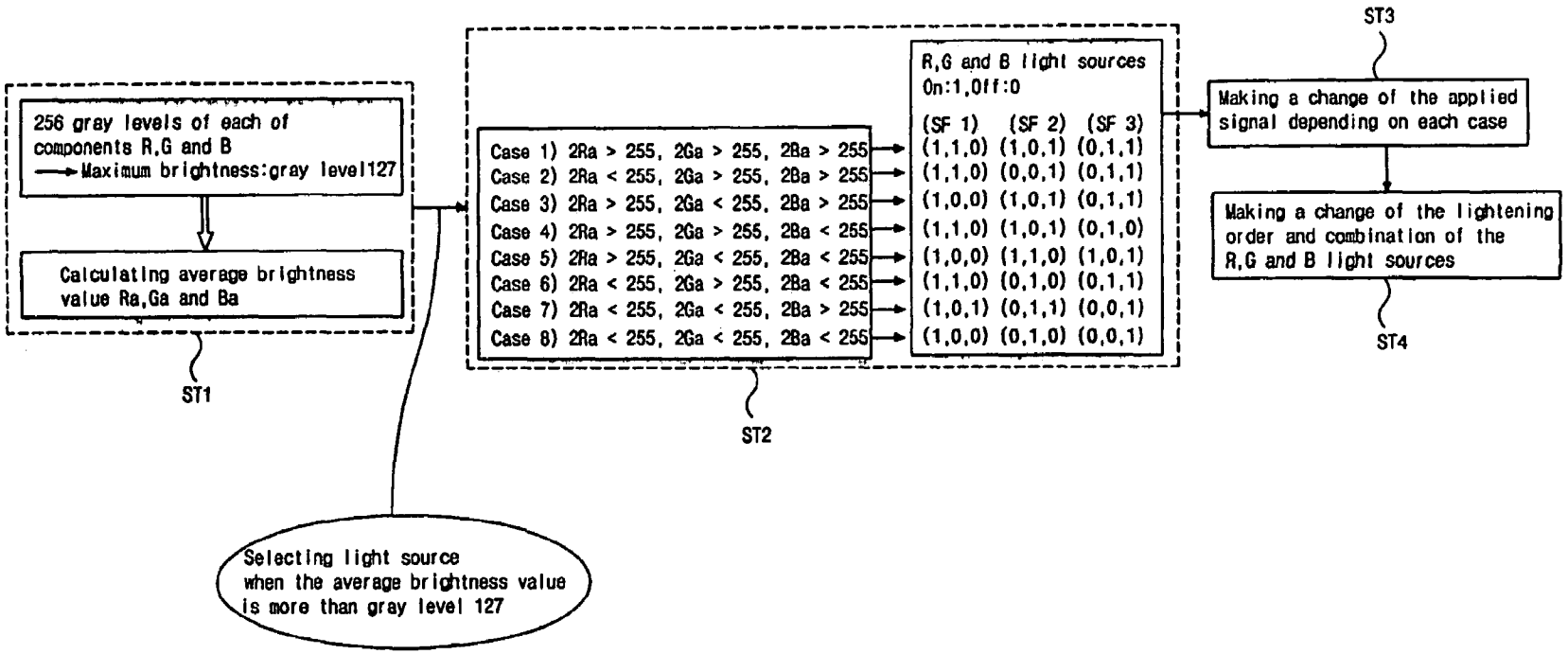
FIG. 14 shows an algorithm according to a fourth embodiment of the present invention.

FIG. 14 shows an algorithm according to a fourth embodiment of the present invention. The brightness of each component R, G and B in color image signal is expressed with a gray level having 256 levels. When the brightness of each component R, G and B has a value of gray level 127, it is set as a maximum brightness. The inputted signals generally have an influence on the gray level of the liquid crystal display device.

As shown in FIG. 14, when the image signal for a full screen is inputted, an average brightness value Ra, Ga and Ba of each of components R, G and B is calculated in step ST1. Each of the R, G and B light sources will be selected when each of the average brightness values Ra, Ga and Ba is more than the gray level 127.

In step ST2, the light source that is turned on at each subframe is selected depending on each case. The image signals and the sequential lighting order and combination of the R, G and B light sources are controlled by the image processor of the fourth embodiment of the present invention. The On-state of the light source at each subframe is represented by "1", while the Off-state is represented by "0".

In case 1, the average brightness values of components R, G and B are all more than gray level 127. At this time, the combinations of the R, G and B light sources within one frame are (1, 1, 0), (1, 0, 1) and (0, 1, 1) respectively at each first, second and third subframes. In other words, the R light source is turned on in both the first and second subframes, the G light source in both the first and third subframes, and the B light source in both the second and third subframes. Additionally, although the R, G and B light sources are all turned on in all subframes, the color range becomes narrow at this time.

Furthermore, Case 2 represents that the average brightness values of the components G and B are more than gray level 127; Case 3 represents that the average brightness values of the components R and B are more than gray level 127; and Case 4 represents that the average brightness values of the components R and G are more than gray level 127.

Case 5 represents that the average brightness value of the component R is more than gray level 127; Case 6 represents that the average brightness value of the component G is more than gray level 127; and Case 7 represents that the average brightness value of the component B is more than gray level 127.

Finally, Case 8 represents that the average brightness values of the components R, G and B are all less than the gray level 127. At this case, only one light source is sequentially turned on at each subframe.

In Cases 2 to 6, the combination of the turned-on light sources depends on the range of the average brightness values of the components R, G and B.

In step ST3, the image signal applied to each pixel changes depending on each case. Further, the lighting order and combination of the R, G and B light sources are varied depending on each case in step ST4.

Although only one light source is turned on at each subframe in the conventional FS LCD device, the combination of the light sources according to the fourth embodiment is expressed as follows.

Case 1 has the combination (R+G, G+B, B+R); Case 2 has the combination (R+G, B B+G); and Case 5 has the combination (R, R+G, R+B). Furthermore, Case 8 has the combination (R, G, B).

However, Cases 1 to 7 have a problem in the fourth embodiment of the present invention. The color gamut for displaying image becomes narrow as compared with the Case 8. To overcome this problem, a fifth embodiment of the present invention is introduced. Namely, the minimum values of the components R, G and B in chromaticity coordinates are first calculated, and then the minimum values are doubled. When turning on and off the light sources, the lighting of the light sources is determined depending on these doubled values. Thus, full color is displayed and the above-mentioned problem is prevented. Further if the high brightness is required in display, the color distribution of the image can be changed.

Furthermore, the above-mentioned embodiments of the present invention can be utilized in the other display devices except for the liquid crystal display device. As the other display devices, there are DMD.TM. (Digital Micromirror Device) of TI (Texas Instruments Technology) and a liquid crystal display (LCD) projector, for example. The liquid crystal display (LCD) projector is one of color image display devices which enlarges and then projects various moving images or stationary images transmitted from such electronic goods as video player, television set and computer using the liquid crystal display. The above-mentioned systems and method of the presented invention may also be included in the DMD.TM. (Digital Micromirror Device) of TI (Texas Instruments Technology) and the liquid crystal display (LCD) projector as a light source system and method.

As described foregoing, since the image signals and the lighting order and combination of the light sources are controlled depending on the image characteristics according to the FS LCD device of the present invention, the maximum brightness is increased. Further, since the range of the maximum brightness is adjustable, the FS LCD device can be utilized in the other display devices, such as television, DMD or LCD projector.

It will be apparent to those skilled in the art that various modifications and variations can be made in the field sequential liquid crystal display device and the color image display method of the present invention without departing from the spirit or scope of the invention. Thus, it is intended that the present invention cover the modifications and variations of this invention provided they come within the scope of the appended claims and their equivalents.

What is claimed is:

1. A color image display method for a field sequential liquid crystal display device that includes a liquid crystal panel having an upper substrate, a lower substrate, a liquid crystal layer therebetween, and a plurality of pixels; a backlight device under the liquid crystal panel for irradiating light to the liquid crystal panel and having Red, Green and Blue light sources; and an image signal processor controlling a sequential lighting order and combination of the Red, Green and Blue light sources, the method comprising the steps of:

dividing one frame into first, second and third subframes, wherein each subframe has a period of approximately one-third of one frame period;

applying an image signal to each pixel of the liquid crystal panel through the image signal processor; and lighting at least two of the Red, Green and Blue light sources at each subframe through the image signal processor by way of controlling the lighting order and the combination of the Red, Green and Blue light sources, wherein the combination of the Red (R), Green (G), and Blue (B) light sources turned on each subframe is one of sequential combinations consisting of B+G, R+B and R+G to display Cyan (C), Magenta (M) and Yellow (Y) colors, respectively, when the displayed image requires a higher brightness.

2. The method according to claim 1, wherein the image signal processor converts the image signal into a signal corresponding to a C-M-Y mode when the C, M and Y colors are generated, and applies the converted signal to the plurality of the pixels.

3. The method according to claim 2, wherein the image signal processor sequentially lights the R, G and B light sources at each subframe in accordance with the C-M-Y mode.

4. The method according to claim 1, wherein one frame period is approximately 1/60 period.

5. The method according to claim 1, a lighting time of each of the Red, Green and Blue light sources is less than about 1/180 second.

6. The method according to claim 1, wherein one of the R, G and B light sources are turned on and off more frequently than the other two light sources when the displayed image needs an emphasized color.

7. The method according to claim 6, wherein the R light sources is turned on and off not only at the first subframe but also at least one of the second and third subframes when the emphasized color is Red.

8. A color image display method for a field sequential liquid crystal display device that includes a liquid crystal panel having an upper substrate, a lower substrate, a liquid crystal layer therebetween, and a plurality of pixels; a backlight device under the liquid crystal panel for irradiating light to the liquid crystal panel and having Red (R), Green (G) and Blue (B) light sources; and an image signal processor controlling an image signal and a sequential lighting order and combination of the Red, Green and Blue light sources, the method comprising the steps of:

expressing a brightness of each component R, G and B with a gray level having 256 levels;

setting the brightness of each component R, G and B as a maximum brightness when the brightness of each component R, G and B has a value of gray level of at least 127;

calculating the average brightness value of each of the components R, G and B;

classifying cases in accordance with the image signal by which the average brightness values of the components R, G and B is greater than the maximum brightness of the displayed image; and determining which light sources are turned on at the subframes in each case.

9. The method according to claim 8, wherein the number of the turned-on light sources at each subframe is less than two.

10. The method according to claim 8, wherein classifying the cases depends on a range of the average brightness values of the component R, G and B.

11. The method according to claim 8, wherein turning on the light sources is determined by a value that doubles respective minimum values of the components R, G and B in chromaticity coordinates.

12. The method according to claim 8, wherein the liquid crystal layer is Optical Compensated Birefringent (OCB) mode.

13. The Method According To claim 8, Wherein The Liquid Crystal Layer Is Ferroelectric Liquid Crystal (Flc) Mode.

* * * * *